US010309040B2

(12) United States Patent
Meier

(10) Patent No.: US 10,309,040 B2
(45) Date of Patent: Jun. 4, 2019

(54) NONWOVEN-LAYING DEVICE AND OPERATING METHOD

(71) Applicant: AUTEFA SOLUTIONS GERMANY GMBH, Friedberg (DE)

(72) Inventor: Andreas Meier, Affing (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 420 days.

(21) Appl. No.: 15/035,014

(22) PCT Filed: Nov. 6, 2014

(86) PCT No.: PCT/EP2014/073951
§ 371 (c)(1),
(2) Date: May 6, 2016

(87) PCT Pub. No.: WO2014/067704
PCT Pub. Date: May 14, 2015

(65) Prior Publication Data

US 2016/0273141 A1 Sep. 22, 2016

(30) Foreign Application Priority Data

Nov. 8, 2013 (DE) ..... 20 2013 105 029 U

(51) Int. Cl.
*D01G 25/00* (2006.01)

(52) U.S. Cl.
CPC ..... *D01G 25/00* (2013.01)

(58) Field of Classification Search
CPC ..... D01G 25/00
USPC ..... 19/163
See application file for complete search history.

(56) References Cited

U.S. PATENT DOCUMENTS 3,656,383 A * 4/1972 Dibble ..... B65H 67/0434 19/159 A
5,353,477 A * 10/1994 Hille ..... D01G 25/00 19/163
5,400,475 A * 3/1995 Hille ..... D01G 25/00 19/163

(Continued)

FOREIGN PATENT DOCUMENTS

DE 25 42 274 B1 1/1977
DE 26 09 396 A1 9/1977

(Continued)

OTHER PUBLICATIONS

"Linearmotoren—FestoWiki—deutsch", Festo Wi Ki, Apr. 4, 2013 (Apr. 4, 2013), XP002735013, Retrieved from the Internet: URL:http://www.festo.com/wiki/de/Linearmot oren [retrieved on Jan. 26, 2015].

*Primary Examiner* — Shaun R Hurley
(74) *Attorney, Agent, or Firm* — McGlew and Tuttle, P.C.

(57) ABSTRACT

A nonwoven fabric-laying device, in particular a cross-laying device, and an operating method are provided. The nonwoven fabric-laying device (1) is used for folding down and depositing a supplied fibrous sheet (3) to form a multi-layered nonwoven fabric (32) and, for conveying the sheet, has a plurality of linearly movably guided carriages (10 to 16) which are driven by a carriage drive and has a plurality of conveyor belts (7, 8) guided by means of the carriages (10 to 16). One or more carriages (10 to 16) are directly driven by an electric linear motor (19).

20 Claims, 5 Drawing Sheets

(56) References Cited

U.S. PATENT DOCUMENTS

| | | | | |
|---|---|---|---|---|
| 2006/0096065 | A1* | 5/2006 | Simon ..... | B65H 23/188<br>19/163 |

FOREIGN PATENT DOCUMENTS

| | | | |
|---|---|---|---|
| DE | 31 25 946 | A1 | 1/1983 |
| DE | 102 50 089 | A1 | 5/2004 |
| DE | 10 2012 008 931 | A1 | 11/2013 |
| EP | 0 315 930 | A2 | 5/1989 |
| EP | 0 609 907 | A2 | 8/1994 |
| EP | 1 010 785 | A2 | 6/2000 |
| EP | 1 010 786 | A2 | 6/2000 |
| EP | 1 828 453 | B1 | 6/2008 |
| WO | 2006/069651 | A1 | 7/2006 |
| WO | 2014/037503 | A1 | 3/2014 |

* cited by examiner

NONWOVEN-LAYING DEVICE AND OPERATING METHOD

CROSS REFERENCE TO RELATED APPLICATIONS

This application is a United States National Phase Application of International Application PCT/EP2014/073951 filed Nov. 6, 2014 and claims the benefit of priority under 35 U.S.C. § 119 of German Application 20 2013 105 029.6 filed Nov. 8, 2013 the entire contents of which are incorporated herein by reference.

FIELD OF THE INVENTION

The present invention pertains to a nonwoven-laying device especially cross-laying device, for folding down and depositing a fed fibrous web into a multilayer nonwoven, wherein the nonwoven-laying device has a plurality of linearly movably guided carriages driven by a carriage drive and a plurality of conveyor belts guided via the carriages and an operating method therefor.

BACKGROUND OF THE INVENTION

Such a nonwoven-laying device is known from EP 1 828 453 B1. It is configured as a cross-laying device and has two linearly movable main carriages and two auxiliary carriages, which are designed as tensioning carriages and are likewise movable linearly. Furthermore, two endless conveyor belts are present, which are guided at the aforementioned carriages via deflection rollers. The main carriages are provided each with a carriage drive of their own and can move relative to one another. These carriage drives comprise, in practice, a rotary drive motor and a toothed belt or cable transmission for transmitting the rotation of the motor to the respective main carriage and to convert the driving rotation into a linear travel motion. The tensioning carriages are connected to a respective main carriage via towing cables.

EP 1 010 785 A2 shows a similar nonwoven-laying device, which has a greater laying width and a larger number of auxiliary carriages. One or more auxiliary carriages may be designed as support carriages for a horizontally extending lower run or carrying run of a conveyor belt.

SUMMARY OF THE INVENTION

An object of the present invention is to provide an improved nonwoven-laying device along with an operating method.

Providing one or more carriage drives of the nonwoven-laying device with an electric linear motor has various advantages. On the one hand, the dynamics, especially the speed of travel and the ability of the carriage drive and of the carriage connected thereto to accelerate are improved. In addition, inertias and vibrations can be reduced.

An electric linear motor is characterized by a linear stator and a slider mounted and guided thereon, especially a slide. The stator may have a finite and freely variable length, which can be adapted to the dimensions of the particular nonwoven-laying device. It is preferably mounted stationarily in the frame of the nonwoven-laying device, and this mounting may be performed especially at the front ends of the stator. It advantageously extends in the direction of motion of the driven nonwoven-laying device carriage. The electric linear motor and its stator may form a carrying part of the frame. The slider, especially the slide, may be connected to the driven carriage. It may especially be integrated in the carriage, especially in the carriage frame thereof.

A carriage of the nonwoven-laying device can be driven by an electric linear motor directly and in its intended direction of motion. A transmission inserted between the carriage and the carriage drive for transmitting the drive, especially a cable, belt or chain drive or the like, may be eliminated.

The hitherto known lateral edge and edge thickening problems of the laid nonwoven can be significantly reduced in a nonwoven-laying device. These were due hitherto to inertia problems of the laying carriage and its carriage drive during deceleration, stopping and repeated accelerations at the ends of its path of motion or the laying width. An electric linear motor markedly shortens the deceleration and acceleration paths and reduces the thickening effect, which develops due to differences between the speed of the laying carriage and the velocity at which the fibrous web runs out.

On the other hand, very high positioning and repetition accuracy is achieved. In addition, the control and regulation characteristics of the carriage drive or linear motor provided with a control of its own or connected to a higher-level control are improved. An electric linear motor responds to control commands more rapidly and sensitively than the prior-art drive.

Furthermore, other and improved possibilities arise for arranging and mounting the driven carriages. The hitherto necessary independent carriage guide on the frame of the nonwoven-laying device may be eliminated. An electric linear motor may be used to guide, mount and support a carriage. Special advantages arise concerning the reduction of friction and inertia in case of a linear motor, which has an electromagnetic and contactless guide means between its slider and its stator. Such a guiding and mounting technique is also advantageous concerning the reduction of friction. In addition, advantages arise in terms of a reduction of wear and a markedly reduced risk of contamination for the fibrous web and nonwoven material.

A carriage may be connected to and also guided and supported on only one electric linear motor or on a plurality of electric linear motors. The electric linear motors are connected to one another for control in a suitable manner in case of such a multiple arrangement. This may be a coupling and a synchronization. It is, however, also possible to set kinematic differences deliberately if needed, if a certain carriage behavior, e.g., a deliberate oblique positioning of one or more deflecting devices arranged at a carriage for a conveyor belt, is desired during the operation of the nonwoven-laying device.

The use of electric linear motors has, furthermore, advantages for the guiding and the holding of the fibrous web at the deflecting devices, especially deflection rollers, of the carriages. Electrostatic adhesion can be achieved here especially by generating an electric field. The electric field may be supplied by the electric linear motor. This aspect of the present invention is of independent significance and can also be achieved in other types of carriage drives, especially other linear direct drives. These may also be other types of electric drives.

A carriage drive with one or more electric linear motors may be provided as original equipment in a brand new nonwoven-laying device. As an alternative, it may be used to retrofit an existing nonwoven-laying device.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
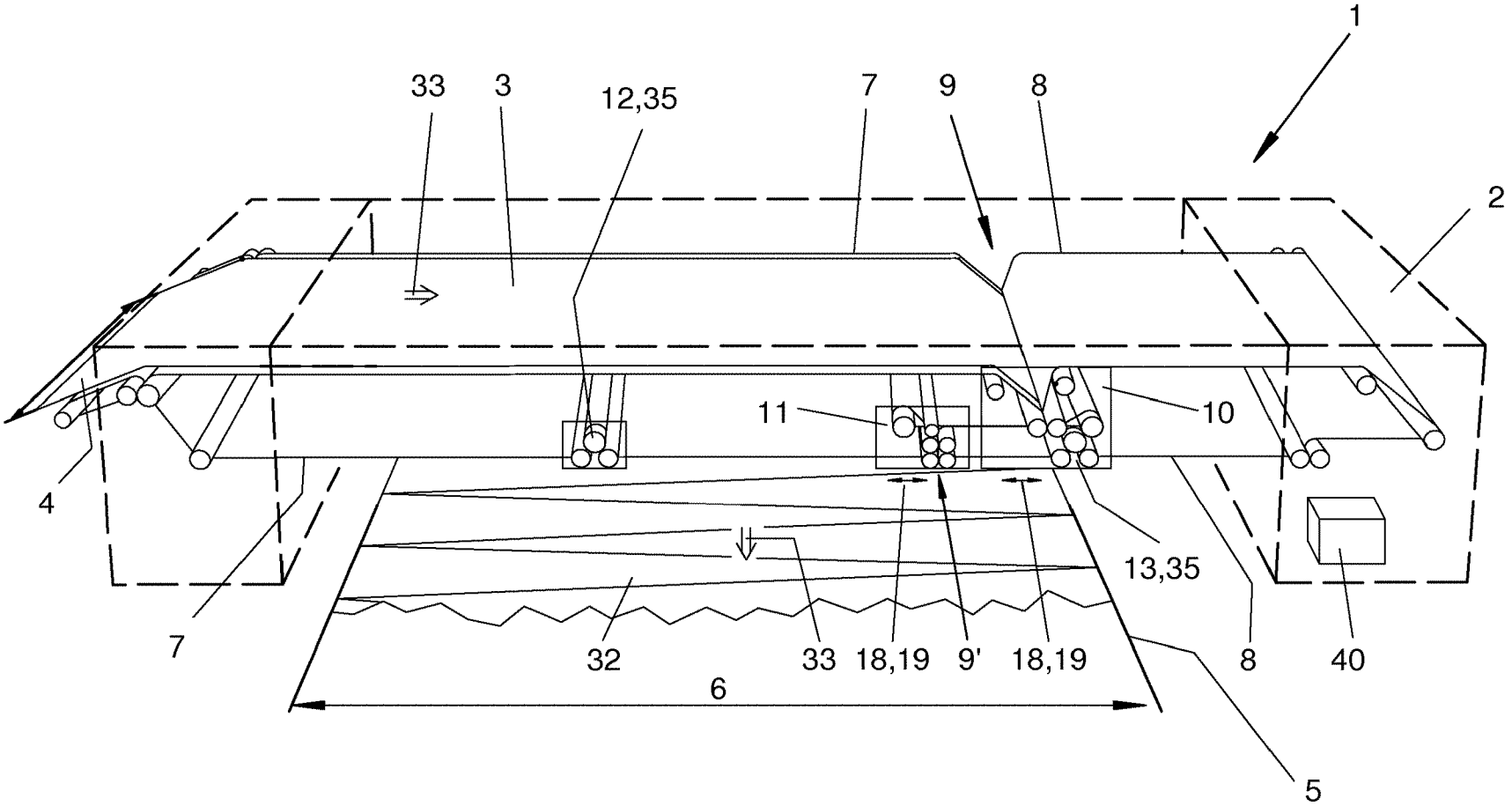
FIG. 1 is a perspective view showing a first variant of a nonwoven-laying device with a plurality of carriages with linear motors.

Referring to the drawings, the present invention pertains to a nonwoven-laying device (1) and to a method for operating same.

FIGS. 1 through 4 show a nonwoven-laying device (1) in different exemplary variants. The nonwoven-laying device (1) is configured, e.g., as a cross-laying device, which deposits and lays a fibrous web (3) being fed on a feeding conveyor (4) on a discharge conveyor (5) while folding down and forming a multilayer nonwoven (32). The discharge conveyor (5) and its direction of conveying are directed at right angles or obliquely to the direction of conveying (33) of the fibrous web (3) being fed.

The fibrous web (3) may be a one-layer or multilayer web. It is made available by a formed fabric generator (not shown) arranged upstream, which is configured, e.g., as a carding engine. Furthermore, one or more auxiliary devices, e.g., a formed fabric storage device, a profiling device, especially a drawing frame, for the fibrous web (3) arriving from the formed fabric generator or the like, may be arranged upstream of the nonwoven-laying device (1).

The discharge conveyor (5) is, in turn, connected to a device for further conveying or further processing the multilayer nonwoven (32). This may be, e.g., a nonwoven strengthening device, especially a needling machine, a water jet strengthening device, a thermobonding device or the like. As an alternative, the nonwoven (32) may be subjected to further processing in another manner by being, e.g., rolled up and/or provided with additional fibers, e.g., melt-blown fibers. The feeding conveyor (4) and/or the discharge conveyor (5) may be designed as conveyor belts, which have, e.g., an endlessly circulatingly guided and driven conveyor belt.

The nonwoven-laying device (1) has a frame (2) and a plurality of carriages (10-16) intended for transporting the fibrous web (3) as well as a plurality of fibrous web conveying means (7, 8) guided via the carriages (10-16), e.g., conveyor belts. At least some of the carriages (10-16) are guided linearly movably and are driven by a carriage drive (18). The number, design, arrangement and function of the carriages (10-16) in a nonwoven-laying device (1) may differ.

Different examples will be described below.

The carriage drive (18) has an electric linear motor (19). It may also have a plurality of electric linear motors (19). These may be connected, e.g., in parallel and drive the carriage (10-16) together. Such a linear motor (19) may also be used to guide and support a carriage (10-16). The carriage drives (18) and their electric linear motors (19) of a plurality of carriages may be coupled and coordinated with one another for control.

The one or more electric linear motors (19) form a direct drive for the carriage (10-16) in question. The carriage (10-16) is connected directly, preferably integrally to a movable driven part, especially a slider (22), an electric linear motor (19).

The conveyor belts (7, 8) are designed as endless flexurally elastic belts driven circulatingly by belt drives (not shown), which are guided at the carriages (10-16) and optionally in the frame (2) via deflecting devices (36, 37, 38), e.g., freely rotatable deflection rollers. The conveyor belts (7, 8) are guided in the nonwoven-laying device variants being shown via a plurality of carriages (10-16) each and they connect these. A coupling may likewise be present for control between the belt drives and the carriage drives (18) and their linear motors (19).

In the exemplary embodiments according to FIGS. 1 through 7, the nonwoven-laying device (1) has a plurality of and especially two main carriages (10, 11). The nonwoven-laying device (1) may have, moreover, one or more auxiliary carriages (12-16). The auxiliary carriage or carriages (12-16) may likewise interact with the conveyor belt or conveyor belts (7, 8). They may have identical or different functions, e.g., for protecting a run of a conveyor belt and/or for tensioning a conveyor belt (7, 8). The carriages (10-16) may perform parallel reversing travel motions. The one or more auxiliary carriages (12-16) may have a carriage drive (18) of their own with one or more electric linear motors (19) or a mechanical drive connection (28-31) to another carriage, especially a main carriage (10, 11).

In the exemplary embodiments shown, a main carriage (10) is configured as an upper carriage with a belt intake (9) and a main carriage (11) as a laying carriage with a belt outlet (9'). Both main carriages (10, 11) move above the discharge conveyor (5) at right angles or obliquely to the direction of conveying thereof, reversing to and fro, the fibrous web (3) exiting at the belt outlet (9) of the laying carriage (11) and being deposited on the discharge conveyor (5) and folded over in the process. For this, the laying carriage (11) moves to and fro over the laying width (6) and in a parallel plane above the discharge conveyor (5).

The two conveyor belts (7, 8) are brought together at the belt intake (9) of the main carriage or upper carriage (10) and take up the fibrous web (3) between them. One conveyor belt (7) adjoins the feeding conveyor (4) or contains same, and the fibrous web (3) is delivered and fed on the conveyor belt (7) from the feed side to the belt intake (9). The conveyor belts (7, 8) run parallel in close proximity in the area between the main carriages (10, 11) and clamp the fibrous web (3) between them.

The conveyor belts (7, 8) are deflected by a total of 180° at the two main carriages (10, 11). The conveyor belts (7, 8) again move away from one another at the belt outlet (9') and are led back to the upper carriage (10) and to the belt intake (9) via deflecting devices arranged on both sides of the discharge conveyor (5) at the frame (2), especially via deflection rollers. The fibrous web (3) is deflected by 180° at the upper carriage (10) and by 90° at the laying carriage (11). The conveyor belts (7, 8) moving apart from each other at the belt outlet (9') and extending in opposite directions are aligned with their belt runs located there essentially parallel to the upper side of the discharge conveyor (5) and can cover the laid nonwoven (32).

In the exemplary embodiments being shown, the nonwoven-laying devices (1) are designed as synchronous layers, in which the main carriages (10, 11) perform parallel travel motions in the same direction of travel and at different speeds as well as with different path lengths. The parallel conveyor belt sections and the fibrous web (3) received and especially clamped in between them are guided from the upper main carriage or upper carriage (10) directly to the lower main carriage or laying carriage (11). A so-called short fibrous web run is formed. The main carriages (10, 11) always move one after another in the same arrangement, and the distance between the carriages changes depending on the position of the carriages over the laying width (6).

In another embodiment, not shown, the nonwoven-laying device (1) may be designed as a laying device having opposite direction of motions, in which the parallel sections of the conveyor belt exiting at the upper carriage (10) with the fibrous web (3) received between them are guided via a stationary deflection roller arrangement in the frame (2) and reach the laying carriage (11) only thereafter. Such a laying device having opposite direction of motions may have a design corresponding to EP 0 315 930 A2 in terms of its carriage and belt arrangement as well as the above-mentioned carriage kinematics.

The main carriages (10, 11) are mechanically uncoupled from one another and independently movable in the exemplary embodiments shown. They have each a controlled or regulated carriage drive (18) of their own with at least one electric linear motor (19). The carriage drives (18) of the main carriages (10, 11) are coupled and coordinated with one another for control. They perform predefined and exactly defined travel motions.

The nonwoven-laying device (1) may have a higher-level control (40) for this. All carriage drives (18) and their electric linear motors (19) as well as other drives, e.g., the belt drives for the circulating motion of the conveyor belts (7, 8), may be connected to these. The control (40) itself may be connected to a higher-level system control or with the controls of devices arranged upstream or downstream, especially a profile-forming device and/or a strengthening device.

FIG. 1 shows a variant of a nonwoven-laying device (1), which has, in addition to the two main carriages (10, 11), an auxiliary carriage, which is configured as a support carriage (12) and which supports the lower run of the conveyor belt (7) arriving from the belt outlet (9') and an omega guide (35) with freely rotatable deflection rollers (37) for this. A supporting device may also be present for the lower run of the other conveyor belt (8). This may be, according to FIG. 1, a support carriage (13), which is arranged rigidly at the upper carriage (10) and is, e.g., structurally integrated there, with an omega guide (35) of the above-mentioned type. As an alternative, an additional, independently movable support carriage may be present.

The support carriage (12) shown moves, coordinated with the travel motions of one or both main carriages (10, 11), to and fro above the discharge conveyor (5). In the preferred embodiment, the support carriage (12) has a belt drive (18) of its own, which has one or more, especially two electric linear motors (19) (not shown). This carriage drive is coupled for control with a main carriage (10, 11), e.g., the upper carriage (10), and the carriage drive (18) thereof. The carriage drive (18) of the support carriage (12) is preferably likewise connected to the control (40). The support carriage (12) may move synchronously with the upper carriage (10), and it performs half paths at half the velocity compared to the laying carriage (11). The support carriage (12) is arranged between the laying carriage (11) and the opposite part of the frame (2).

Figure 2:
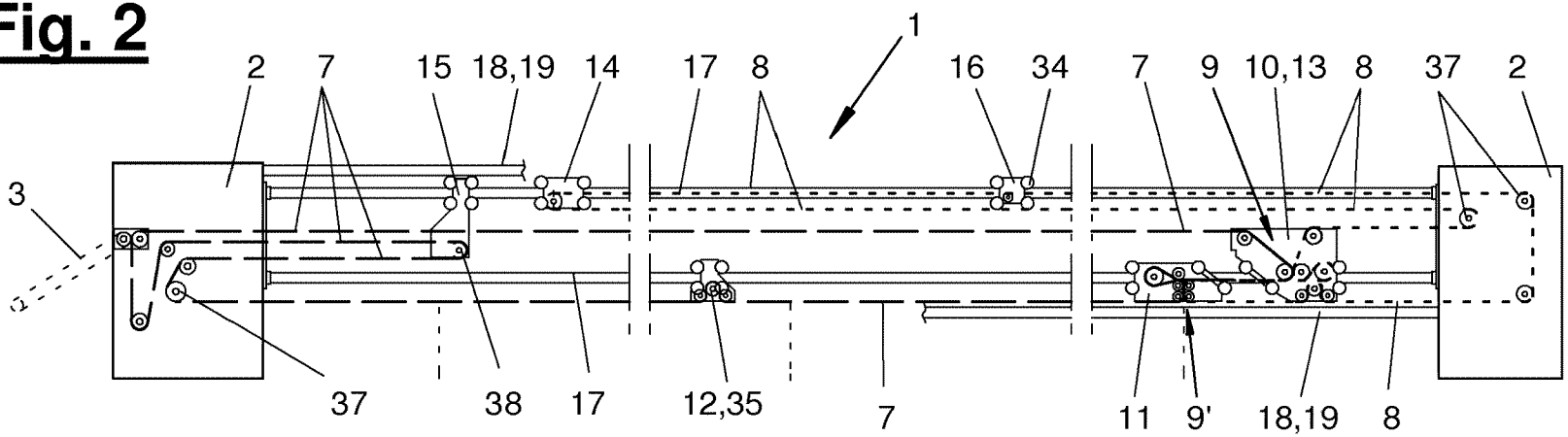
FIG. 2 is a side detail view of a second variant of a nonwoven-laying device with a number and arrangement of carriages.
Figure 3:
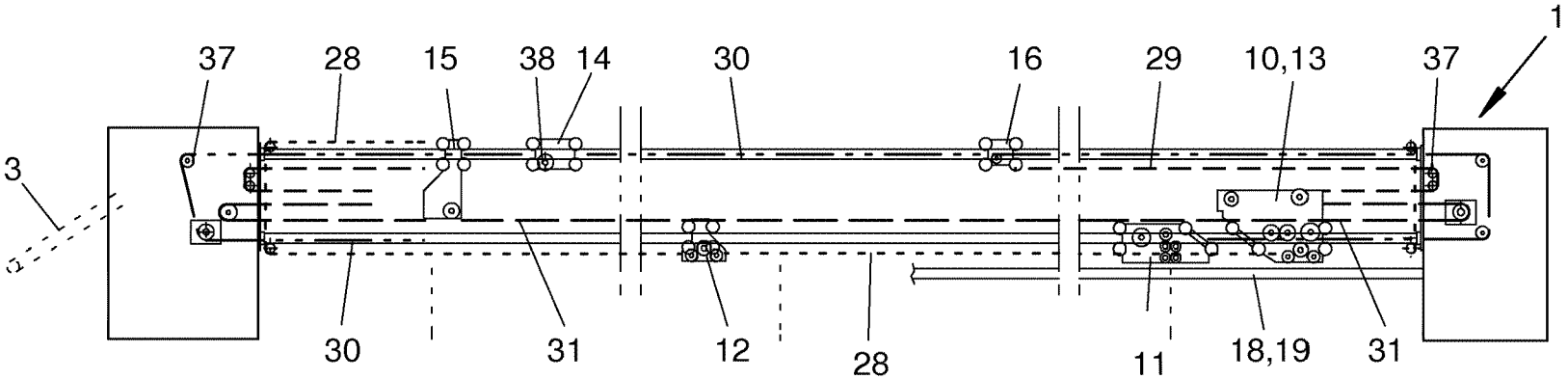
FIG. 3 is another side detail view of the second variant of a nonwoven-laying device with a number and arrangement of carriages.

FIGS. 2 and 3 show a variant to FIG. 1, in which the nonwoven-laying device (1) has additional auxiliary carriages (14, 15, 16), which may likewise have a carriage drive (18) of their own with one or more electric linear motors (19) (not shown).

In addition to the above-described support carriage (12), which is movable on its own, as well as the support carriage or support device (13) coupled with the upper carriage (10), an upper support carriage (16) is provided for a carrying run of one conveyor belt (8). The support carriage (16) is arranged above the main carriage (10, 11) and is located between the upper carriage (10) and an upper auxiliary carriage (14), which is configured as a tensioning carriage. The support carriage (16) or its carriage drive (18) is likewise coupled with the upper carriage (10) for control.

The auxiliary carriages (14, 15) are designed as tensioning carriages for a respective conveyor belt (7, 8). They tension the variable-length belt loop, which is formed during independent travel motions of the mutually uncoupled main carriage (10, 11). The kinematics of the upper tensioning carriage (14) for the conveyor belt (8) is coordinated with the travel motions of the laying carriage (11) and moves in opposite direction relative to this. The carriage drives (18) are correspondingly coupled with one another and coordinated with one another for control and are connected to the control (40). The kinematics of the other, lower tensioning carriage (15) for the conveyor belt (7) is coordinated with the travel motions of the upper carriage (10) and moves in the opposite direction relative to this. There is a coupling of the carriage drives (18) for control and a common connection to the control (40) in this case as well.

In the drawings of FIGS. 2 and 3, FIG. 2 shows the course of the conveyor belts (7, 8) and the arrangement of the main and auxiliary carriages (10-16). FIG. 3 shows alternative kinematic couplings of the main and auxiliary carriages (10-16). Only the main carriages (10, 11) have a carriage drive (18) with one or more electric linear motors (19) in this variant, and there is a mechanical drive connection (28, 29, 30, 31), which is formed, e.g., by tension-proof and flexurally elastic connection means, e.g., cables or belts, between the main carriages (10, 11) and the associated auxiliary carriages (12-16). The upper carriage (10) is coupled with the lower support carriage (12) via a drive connection (28) and with the upper support carriage (16) via another drive connection (29). Further, there is a drive connection (30) between the upper carriage (10) and the lower tensioning carriage (15). The upper tensioning carriage (14) is coupled by the drive connection (30) with the laying carriage (11).

Figure 4:
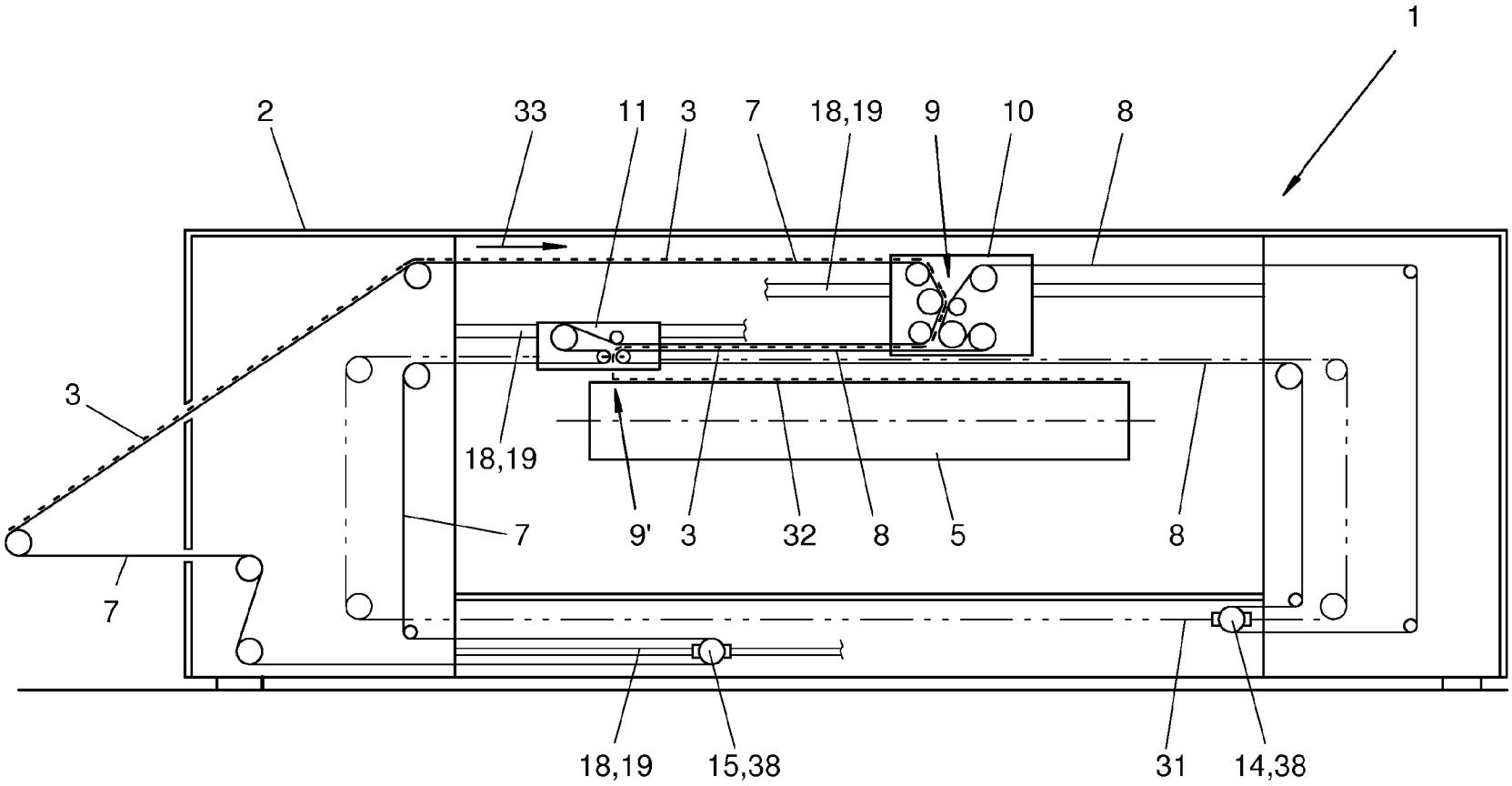
FIG. 4 is a side view showing a third variant of a nonwoven-laying device with a plurality of carriages and linear motors.

FIG. 4 shows another variant of a nonwoven-laying device (1) with two main carriages (10, 11) and two tensioning carriages (14, 15). The tensioning carriage (14) is coordinated kinematically with the laying carriage (11), FIG.

4 showing the variant of a mechanical drive connection (31). A separate carriage drive (18) with an electric linear motor (19) is shown in the other tensioning carriage (15), whose kinematics is coordinated with the upper carriage (10).

In a variation of the exemplary embodiments according to FIGS. 1-4, there also may be mixed forms, in which some of the auxiliary carriages (12-16) have a carriage drive (18) of their own with at least one electric linear motor (19) and the others have a mechanical drive connection.

The carriage drives (18) and their electric linear motors (19) can be controlled or regulated. Suitable measuring devices (39), which detect the position and/or the path and/or the velocity of the corresponding carriage (10-16) or of a part of the carriage drive (18) connected thereto preferably with contactless sensors, are present for regulation. The measuring device(s) (39) is (are) schematically shown in FIG. 5 and is (are) likewise connected to the control (40). As an alternative, there may be a direct connection with the internal control of the electric linear motor (19).

Figure 5:
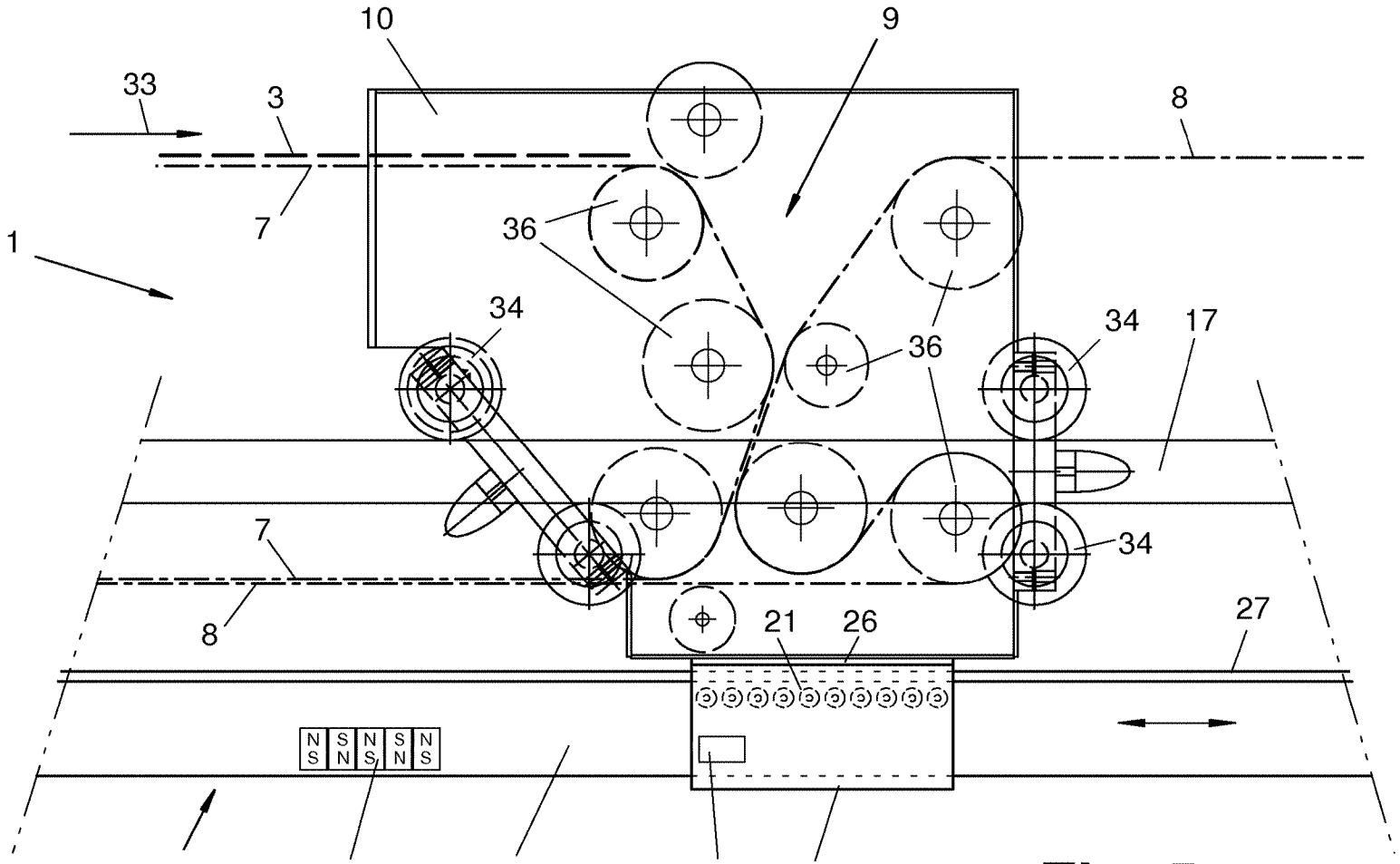
FIG. 5 is an enlarged and cut-away detail view of a main carriage along with a linear motor of the nonwoven-laying device according to FIG. 4.

In a cut-away view, FIG. 5 schematically shows an upper carriage (10) and the carriage drive (18) thereof with an electric linear motor (19). The electric linear motor (19) may be present as a single motor or as a plurality of motors. It has a primary part (20) each with an electric coil array (21) and a secondary part (23) with a magnet array (24). The coil array is energized and generates an electromagnetic field, which interacts with the field of the magnet array (24). The magnet array (24) has, e.g., permanent magnets with changing polarity.

The electric linear motor (19) has a linear stator (25) and a slider (22) movably guided thereon by means of a guide (27). The stator (25) has a finite and selectable length. It extends along the path of travel and at least over the path length of the corresponding carriage (10-16). It may also be longer than the travel path. The stator (25) is supported at the frame (2). It may optionally also assume a carrying frame function. For example, the stator (25) extends in this case beyond the discharge conveyor (5) to the frame parts (12) arranged on both sides of the discharge conveyor (5) and is supported and fastened there with its ends.

The guide (27) is configured, e.g., as a guide rail and is mounted at the stator (25). The slider (22) may be designed as a slide, which is mounted at the guide (27). The mounting may be designed as a mechanical roller or slide bearing. As an alternative, it may be designed as a contactless bearing with magnetic or electromagnetic fields. The slider or slide (22) may extend in some areas or fully around the stator (25), as this is shown as an example in FIG. 7. The guide (27) may also be designed as a contactless air cushion guide.

The slider (22) is connected to the associated carriage (10-16) in a suitable manner, e.g., by means of a connection (26). This may be a fixed or movable connection. A carriage (10-16) may be connected, e.g., by its carriage frame (41) directly to the slider (22), in which case the connection (26) is configured, e.g., as a screw-on surface. As an alternative, the connection (26) may be designed as a spacer. The fastening may be rigid or movable within certain limits, e.g., spring-loaded. In another variant, a part of the carriage frame (41) may be designed as a slider (22), especially as a slide.

The slider (22) forms the primary part (20) with the coil array (21) and the stator (25) the secondary part (23) with the magnet array (24) in the examples being shown. The association may also be reversed, as an alternative.

The carriages (10-16) have a carriage guide (17) each. This may have a conventional design and be formed by guides, e.g., bars or rails at the frame (2), on which the carriages (10-16) act with rollers (34) on a plurality of sides and are guided in the axial direction of motion. FIGS. 1-6 show this variant.

As an alternative or in addition, the carriages (10-16) may be guided and supported via the respective carriage drive (18) and the electric linear motor(s) (19) thereof. The stator (25) is used as a support, and the guide (27) forms the carriage guide (17). The carriages (10-16) are supported and guided now at the stator (25) via the connected slider (22).

Figure 7:
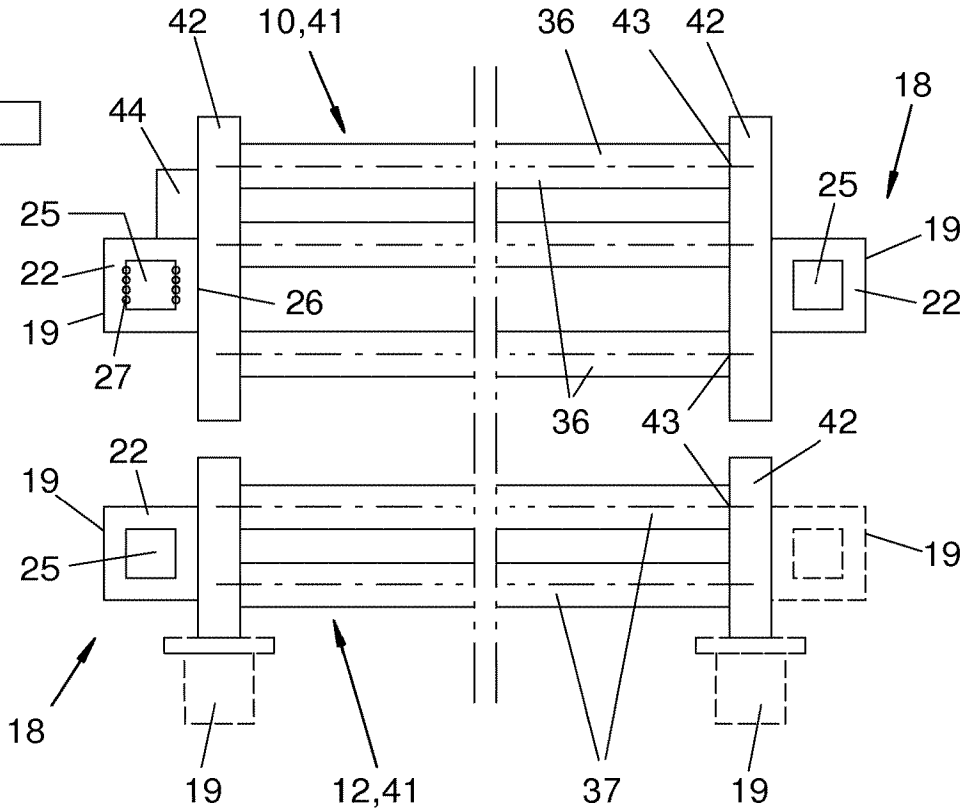
FIG. 7 is a cut-away front view of a carriage with carriage frames and deflecting devices along with linear motors of a nonwoven-laying device.
Figure 6:
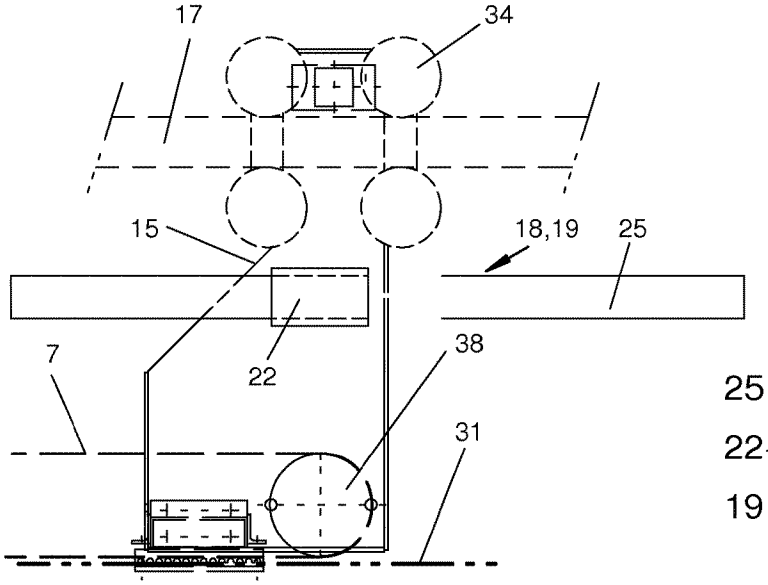
FIG. 6 is a cut-away and enlarged detail view of an auxiliary carriage with linear motor of the nonwoven-laying device from FIGS. 2 and 3.

FIGS. 6 and 7 show such an arrangement as an example. The carriages (10, 16) have a carriage frame (41) each with the deflecting devices (36, 37, 38) mounted thereon. These deflecting devices are preferably designed as rotatable, especially freely rotatable deflection rollers. The carriage frame (41) has two upright frame sides (42), which are located at laterally spaced locations and between which said deflecting devices (36, 37, 38) is received by means of a mounting (43). The bilateral frame sides (42) are connected to the carriage guide (17).

FIG. 7 shows a carriage guide (17) embodied by linear motors (19) arranged on both sides of the respective carriage (10-16). A hanging or upright mounting or connection is possible here as desired, and the electric linear motors (19) are arranged, as desired, above or under or next to the carriage frames (41) or one or both frame sides (42).

FIG. 7 shows, in addition, in the lower part that a carriage drive (18) may have only one electric linear motor (19) or a plurality of, especially parallel, electric linear motors (19). The linear motor or linear motors (19) may act or be mounted in the above-mentioned manner on the side, on the top side or on the underside of the carriage frame (41) or of the frame sides (42).

FIG. 7 shows, further, the arrangement of a holding device (44) at a carriage (10-16) or at the carriage frame (41) thereof. At one or more deflecting device (36, 37, 38), the holding device (44) generates an electric field, especially an electrostatic field, with which the fibrous web (3) can be held and guided during the deflection. The electric field counteracts the centrifugal forces developing during the deflection and holds the fibrous web (3) in contact with the transporting conveyor belt (7, 8). The conveyor belt (7, 8) may be correspondingly permeable to the field for this. The holding device (44) preferably acts at the deflection points or deflecting devices at which the fibrous web (3) is transported in the open state, in a lying position on a conveyor belt (7, 8).

The field voltage supply may be effected by the electric linear motor (19). The holding device (44) may be supplied with electric voltage via an electric linear motor (19) and especially via the slider (22) thereof. This voltage supply may be controllable in order to make it possible to set the particular field intensity needed in adaptation to the existing operating parameters, especially the velocity of travel, deflection angle, the quality of the fibrous web, etc. The holding device (44) may likewise be connected to the control (40).

The holding device (44) for guiding and holding a fibrous web (3) with an electric, especially electrostatic field is of independent inventive significance. It may also be used with other types of direct or indirect carriage drives of a nonwoven-laying device (1) according to the preamble of claim 1, especially with linear direct drives for a carriage (10 through 16). These may be especially other types of direct electric drives, fluid drives with cylinders or the like. Said holding device (44) may, in addition, be arranged at or associated with a deflecting device in the frame (2) of the nonwoven-laying device (1).

Various variants of the embodiments shown and described are possible. In particular, the features of the various exemplary embodiments may be combined with one another as desired and possibly also replaced with one another.

As an alternative, the nonwoven-laying device (1) may be designed as a carriage laying device, wherein at least the main carriages have a respective circulating conveyor belt of their own and are mounted movably in relation to one another and driven with the above-described carriage drives (18). Such a carriage laying device may be designed, for example, according to DE 31 25 946 A1. Furthermore, a nonwoven-laying device (1) may be designed as a vertical laying device or so-called camelback laying device. This may have, e.g., a design corresponding to DE 102 50 089.

While specific embodiments of the invention have been shown and described in detail to illustrate the application of the principles of the invention, it will be understood that the invention may be embodied otherwise without departing from such principles.

The invention claimed is:

1. A nonwoven-laying device for folding down and depositing a fed fibrous web into a multilayer nonwoven, the nonwoven-laying device comprising:

a nonwoven-laying device frame;

a plurality of linearly movably guided carriages;

a discharge conveyor having a discharge conveyor extent;

a carriage drive arrangement driving the guided carriages and comprising one or more carriage drives with an electric linear motor; and a plurality of conveyor belts guided in movement via the plurality of carriages, wherein:

the electric linear motor comprises a linear stator and a slider guided movably thereon;

the linear stator is fastened to the nonwoven-laying device frame and is configured as a carrying component of the frame;

the slider is connected to at least one of the carriages;

frame parts of the nonwoven-laying device frame are arranged on both sides of the discharge conveyor;

the linear stator extends beyond the extent of the discharge conveyor to the frame parts arranged on both sides thereof;

the electric linear motor comprises a primary part with a coil array and a secondary part with a magnet array; and the slider is configured as the primary part and the linear stator is configured as the secondary part.

2. A nonwoven-laying device in accordance with claim 1, wherein:

the carriages comprise two main carriages, which are mechanically uncoupled from one another and are movable independently from one another;

the carriage drive arrangement comprises at least another carriage drive with another electric linear motor to provide at least two carriage drives of the main carriages;

the respective carriage drive is controlled or regulated independently, with each of the carriage drives comprising at least one of the electric linear motor;

the carriage drives of the main carriages are coupled for control and are coordinated with one another;

the main carriages are driven, to perform parallel travel motions with identical direction of travel and different velocities of travel and with different path lengths, by the respective carriage drives.

3. A nonwoven-laying device in accordance with claim 1, wherein the carriages comprise one or more auxiliary carriages for tensioning and/or supporting a conveyor belt.

4. A nonwoven-laying device in accordance with claim 3, wherein the one or more auxiliary carriage comprises a carriage drive of its own with at least one electric linear motor and is connected with its associated main carriage for control.

5. A nonwoven-laying device in accordance with claim 1, wherein the electric linear motor has a guide between the stator and the slider.

6. A nonwoven-laying device in accordance with claim 5, wherein the guide is configured as a mechanical guide comprising a rail guide, or a magnetic guide.

7. A nonwoven-laying device in accordance with claim 1, wherein the carriage drive comprises the electric linear motor cooperating with a measuring device for one or more motion parameters comprising path, position, velocity and acceleration.

8. A nonwoven-laying device in accordance with claim 1, wherein the carriage is rigidly or movably connected to the slider via a connection.

9. A nonwoven-laying device in accordance with claim 5, wherein at least one driven carriage is guided and supported at the frame of the nonwoven-laying device via the guide of the electric linear motor or via a carriage guide of its own.

10. A nonwoven-laying device in accordance with claim 1, wherein the carriage drive has the electric linear motor and another electric linear motor to provide two parallel electric linear motors for each of the carriages.

11. A nonwoven-laying device in accordance with claim 1, wherein at least one carriage has a carriage frame with lateral frame sides for the end-side mounting of the one or more deflecting devices comprising at least one deflection roller, wherein at least one frame side is connected to the electric linear motor.

12. A nonwoven-laying device in accordance with claim 1, wherein at least one carriage, frame, forms an integral assembly unit with the slider of the electric linear motor, whereby a part of the carriage frame is configured as the slider of the electric linear motor.

13. A nonwoven-laying device in accordance with claim 1, wherein one of the carriages has a holding device, which fixes the fibrous web at a deflecting device comprising a deflection roller, with an electric field.

14. A method for operating a nonwoven-laying device, the method comprising the steps of:

folding down and depositing a fed fibrous web into a multilayer nonwoven, with the nonwoven-laying device;

providing the nonwoven-laying device with a plurality of linearly movably guided carriages driven by a carriage drive, a plurality of conveyor belts guided in movement with the carriages, a nonwoven-laying device frame, and a discharge conveyor having a discharge conveyor extent;

providing the carriage drives with an electric linear motor comprising a linear stator and a slider guided movably thereon;

fastening the linear stator to the nonwoven-laying device frame with the linear stator configured as a carrying component of the frame;

connecting the slider to at least one of the carriages;

arranging frame parts of the nonwoven-laying device frame on both sides of the discharge conveyor;

extending the linear stator beyond the extent of the discharge conveyor to the frame parts arranged on both sides thereof;

providing the electric linear motor with a primary part with a coil array and a secondary part with a magnet array with the slider configured as the primary part and with the linear stator configured as the secondary part; and driving one or more carriages by the electric linear motor.

15. A method in accordance with claim 14, wherein the electric linear motor drives the carriage directly.

16. A method in accordance with claim 14, wherein the carriages comprise a main laying carriage driven by the electric linear motor.

17. A method in accordance with claim 14, wherein the electric linear motors of a plurality of carriages are coupled with one another for control for coordinating the travel motions of the carriages and their drive motions are coordinated with one another.

18. A nonwoven-laying device in accordance with claim 2, wherein:

the conveyor belts are configured as endless, flexurally elastic and circulatingly driven belts, with each of the belts being guided via deflecting devices at each of the carriages;

the conveyor belts run parallel in the area between the main carriages and clamp the fibrous web between them; and the parallel conveyor belt sections and the fibrous web received and clamped in between the parallel conveyor belt sections are guided from an upper carriage of the carriages directly to a lower carriage of the carriages.

19. A nonwoven-laying device in accordance with claim 1, wherein:

the coil array has a plurality of controllable energized electromagnetic coils; and the magnet array has a plurality of magnets, which magnets alternate in polarity and are arranged axially in a row.

20. A nonwoven-laying device in accordance with claim 2, wherein:

the main carriages are guided and supported via the respective carriage drive; and the stator is configured as a support, and the main carriages are supported and guided at the stator via the connected slider.

* * * * *